US006376786B1

(12) United States Patent
Ishibashi

(10) Patent No.: US 6,376,786 B1
(45) Date of Patent: Apr. 23, 2002

(54) SWITCH DEVICE WITH BROADER OPERABLE RANGE

(75) Inventor: Ikuo Ishibashi, Ibaraki (JP)

(73) Assignee: Kabushiki Kaisha Toshiba, Saiwai-Ku (JP)

( * ) Notice: Subject to any disclaimer, the term of this patent is extended or adjusted under 35 U.S.C. 154(b) by 0 days.

(21) Appl. No.: 09/538,981

(22) Filed: Mar. 30, 2000

(30) Foreign Application Priority Data

Aug. 23, 1999 (JP) ..... 11-235417

(51) Int. Cl.[7] ..... H01H 3/16
(52) U.S. Cl. ..... 200/61.62; 200/61.64
(58) Field of Search ..... 200/33 A–39 R, 200/61.62–61.83, 329–345, 520–574

(56) References Cited

U.S. PATENT DOCUMENTS 3,713,053 A * 1/1973 Mahon ..... 200/38 R
3,796,452 A * 3/1974 Foster et al. ..... 200/61.64 X
3,967,077 A * 6/1976 Willis ..... 200/38 FA
4,663,505 A * 5/1987 Drake ..... 200/61.62
4,745,250 A * 5/1988 Mayo ..... 200/61.62
5,032,697 A * 7/1991 Schilling et al. ..... 200/61.62

* cited by examiner

*Primary Examiner*—J. R. Scott
(74) *Attorney, Agent, or Firm*—Pillsbury Winthrop LLP

(57) ABSTRACT

A switch device includes a base, an operating plate depressed so as to be displaced from a neutral position to a proximity position where the operating plate is in proximity to the base, a first movable member disposed between the base and the operating plate and having a first pivot shaft which extends along the operating plate and about which the first movable member is caused to pivot when the operating plate is depressed, a second movable member disposed between the base and the operating plate and having a second pivot shaft spaced from and extending in parallel with the first pivot shaft, the second movable member pivoting about the second pivot shaft when the operating plate is depressed, the first movable member pivoting upon pivot of the second movable member, a switching element disposed on the base, and a switch operating section disposed on the first movable member for switching a state of the switching element when the first movable member pivots.

13 Claims, 10 Drawing Sheets

SWITCH DEVICE WITH BROADER OPERABLE RANGE

BACKGROUND OF THE INVENTION

1. Field of the Invention

This invention relates to a switch device including an operating plate which is pushed or otherwise operated so that a switching means is switched from one state to another.

2. Description of the Prior Art

FIGS. 10 and 11 illustrate one of conventional switch devices of the above-described type. The shown switch device comprises a generally rectangular operating plate 1, a base 2 and two coil springs 3. Each spring 3 has both ends connected to the operating plate 1 and the base 2 respectively. A push-button switch 4 is provided on the base 2 so as to correspond to a central portion of the operating plate 1. When the operating plate 1 is pushed, an operating element 4*a* of the push-button switch 4 is depressed as shown in FIG. 11 so that the switch is switched from an OFF state to an ON state, for example.

In the aforesaid switch device, however, the operating element 4*a* of the push-button switch 4 is depressed directly by the backside of the operating plate 1. Accordingly, when the central portion of the operating plate 1 is pushed, a distance of movement of a portion of the operating plate abutting against the operating element 4*a* is larger than one when a peripheral portion of the plate 1 away from the central portion is pushed. As a result, the switching operation of the push-button switch 4 becomes unreliable when the peripheral portion of the plate 1 away from the central portion is pushed.

SUMMARY OF THE INVENTION

Therefore, an object of the present invention is to provide a switch device in which the operating plate has a broader operable range.

The present invention provides a switch device comprising a base, an operating plate disposed opposite the base and including an outer face that may be depressed at any part thereof so that the operating plate is displaced from a neutral position to a proximity position where the operating plate is in proximity to the base, a first movable member provided between the base and the operating plate and having a first pivot shaft which extends along the operating plate and about which the first movable member is caused to pivot when the operating plate is depressed, a second movable member provided between the base and the operating plate and having a second pivot shaft spaced from and extending in parallel with the first pivot shaft, the first movable member pivoting about the first pivot shaft when a predetermined part of the outer face of the operating plate is depressed, the second movable member pivoting about the second pivot shaft when a part of the outer face of the operating plate other than the predetermined part is depressed, the first movable member pivoting upon pivot of the second movable member, a switching element provided on the base, and a switch operating section provided on the first movable member for switching a state of the switching element when the first movable member pivots.

According to the above-described construction, the switching element is switched by the switch operating section provided on the first movable member pivoting with depression of the operating plate. Consequently, the state of the switching element can reliably be switched regardless of a location of depression of the operating plate. Moreover, the first movable member pivots upon pivot of the second movable member. Accordingly, the first movable member can pivot even when the depression of the operating plate causes only the second movable member to pivot. As a result, an operable range of the operating plate can be broadened.

The operating plate preferably has an outer surface which is depressed, and the operating plate is displaced from the neutral position to the proximity position when any part of the outer surface of the operating plate is depressed.

The operating plate is preferably displaced from the neutral position to a distant position spaced away from the base when drawn, so that at least one of the first and second movable members is caused to pivot. The operability of the switch device can be improved since the switching element is switched when the operating plate is either depressed or drawn. In this construction, the operating plate preferably includes at least one operating plate shaft parallel with each of the first and second pivot shafts, the operating plate pivoting about one of the operating plate shafts.

The operating plate preferably includes a hand hold formed on one end thereof at the operating plate shaft side, the hand hold being drawn so that the operating plate is caused to pivot about the operating plate shaft to be displaced from the neutral position to the distant position. Further, the operating plate preferably has a pivot thereof transferred sequentially from the operating plate shaft located away from the hand hold to the operating plate shaft located near the hand hold as the operating plate is displaced from the neutral position to the distant position.

On the other hand, FIG. 4 shows a case where a lower part of a front or outer surface of the operating plate 29 assuming the neutral position is depressed in the direction of arrow C. In this case, the operating plate 29 is caused to pivot about the engaged portion of the engaging and engaged members 32 and 49 in the direction of arrow C until the backside of the plate 29 abuts against the stopper 54, whereupon the operating plate is displaced to assume a proximity position where it is in proximity to the unit base 23 or the auxiliary base 48. As a result the projection 45 abut against the second operating portions 53 respectively such that the second movable member 42 is caused to pivot about the shafts 43 against the urging force of the torsion coil spring 46 in the direction of arrow D in FIG. 4 or opposite to arrow A. The projection 44 of the second movable member 42 is then spaced from the receiving portion 41 such that the first movable 37 assumes a free state. As a result, the operating element 27*a* projects forward so that the push-button switch 27 is switched to the ON state. Further, the switch operating section 40 is pushed upward as the result of projection of the operating element 27*a*, whereupon the first movable member 37 is caused to pivot in the direction of arrow E or opposite arrow B.

In the above-described construction, a distance between the pivot and the hand hold is long at an initial stage of the drawing of the operating plate and short at a last stage of the drawing. Accordingly, the operating plate can start to pivot by application of a small force to the hand hold. Furthermore, a moment acting on the operating plate shaft serving as the pivot of the operating plate can be rendered small even when a large force is applied to the hand hold at the last stage of the drawing. Consequently, the breakage of the operating plate shaft can be prevented.

The switch device preferably further comprises a pair of first operating portions provided on portions of the base corresponding to both ends of the operating plate with respect to one direction, the first operating portions causing the first movable member to pivot when the operating plate is depressed, and a pair of second operating portions provided on portions of the base corresponding to both ends of the operating plate with respect to one direction, the second operating portions causing the second movable member to pivot when the operating plate is depressed. The first movable member can reliably be caused to pivot even when a peripheral end portion of the operating plate is depressed.

While the operating plate is assuming the neutral position, the first movable member is preferably spaced away from the first operating portion and the second movable member is spaced away from the second operating portion. Even when parts of the switch device have respective dimensional errors, the first and second operating portions can be prevented from causing the first and second movable members to pivot while the operating plate is assuming the neutral position.

The switching element preferably comprises a push-button switch having an operating element depressed by the switch operating section while the operating plate is assuming the neutral position. The operating element is released from the depression by the switch operating section when the operating plate is operated. That is, the operating element can be prevented from being broken since it is not subjected to a large shock during operation of the operating plate.

BRIEF DESCRIPTION OF THE DRAWINGS

Other objects, features and advantages of the present invention will become clear upon reviewing the following description of the preferred embodiments, made with reference to the accompanying drawings, in which.

DETAILED DESCRIPTION OF THE PREFERRED EMBODIMENT

Figure 7:
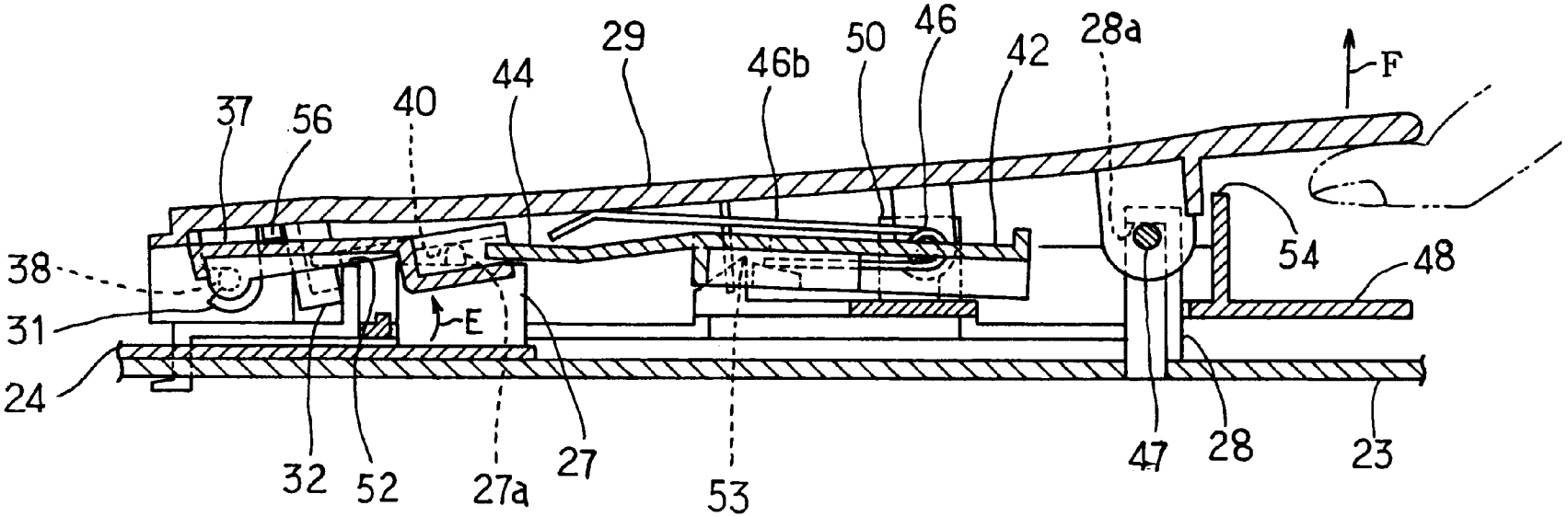
FIG. 7 is a longitudinally sectional side view of the switch device, showing the first and second movable members at a last stage when a hand hold of the operating plate is drawn.
Figure 8:
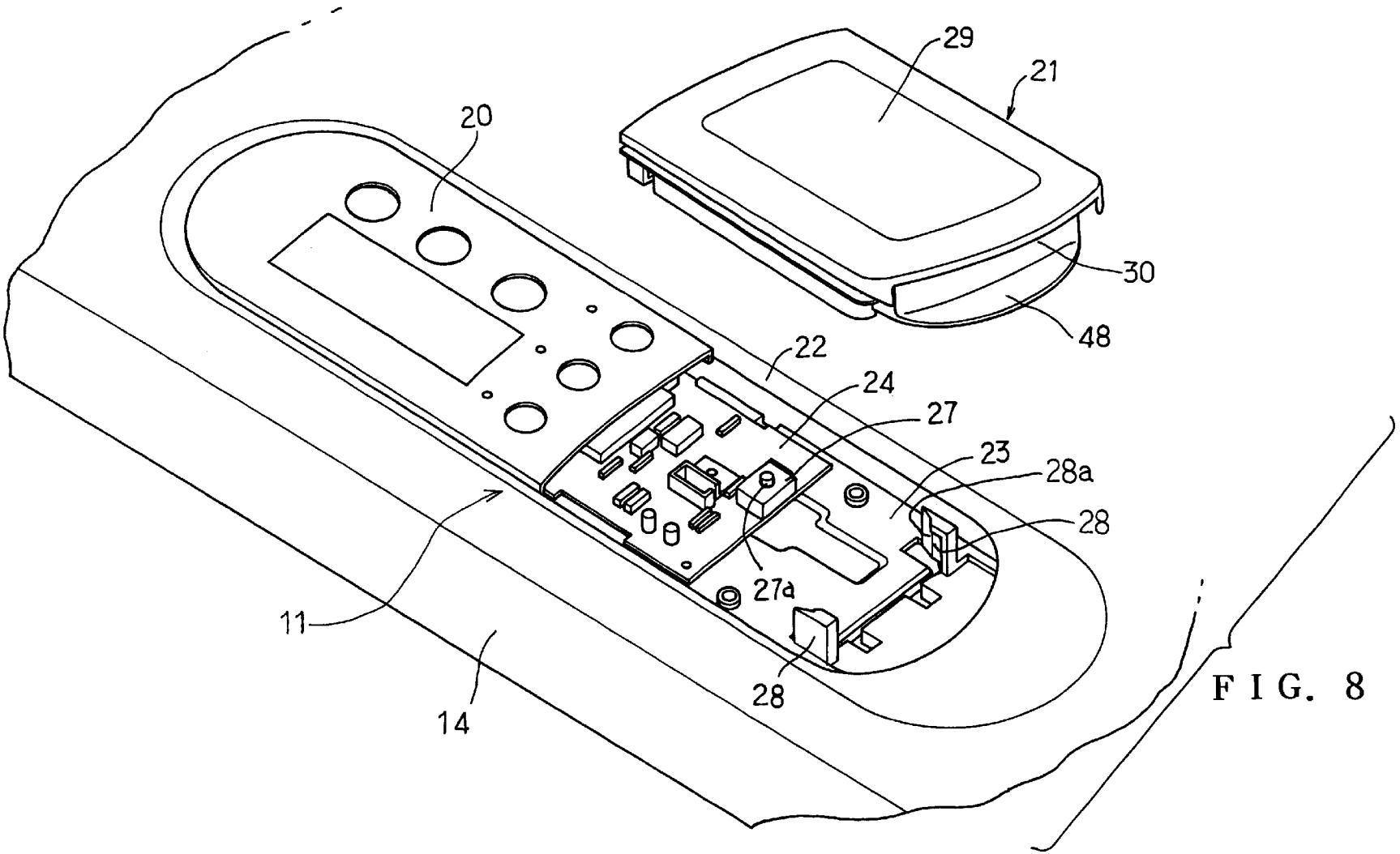
FIG. 8 is a perspective view of an operation unit with the operating plate being removed.
Figure 9:
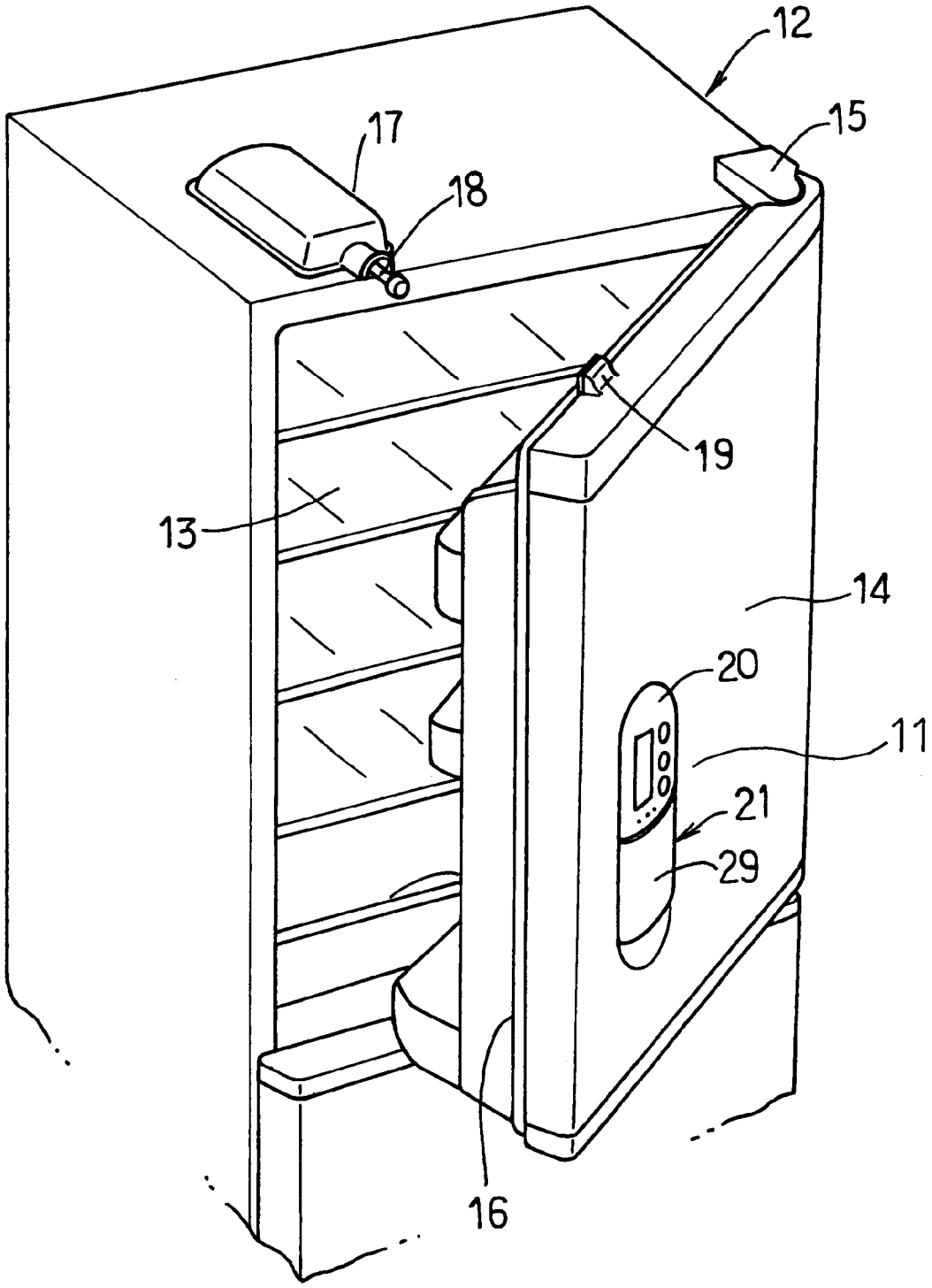
FIG. 9 is a perspective view of an upper portion of the refrigerator.
Figure 10:
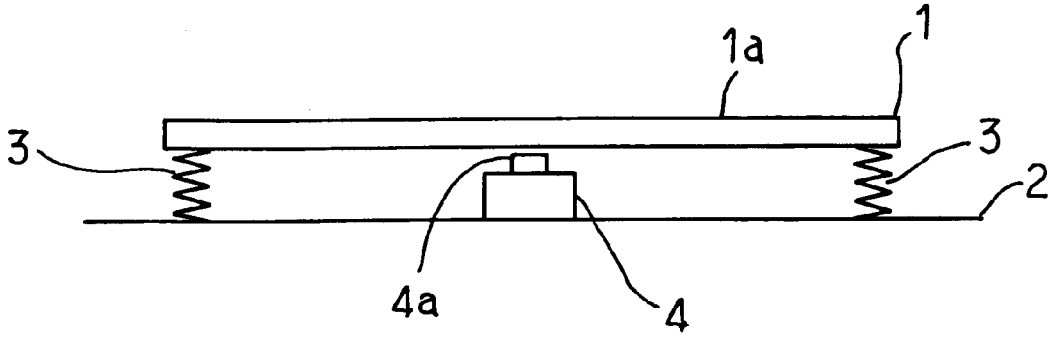
FIG. 10 PRIOR ART
FIG. 10 illustrates a prior art switch device.
Figure 11:
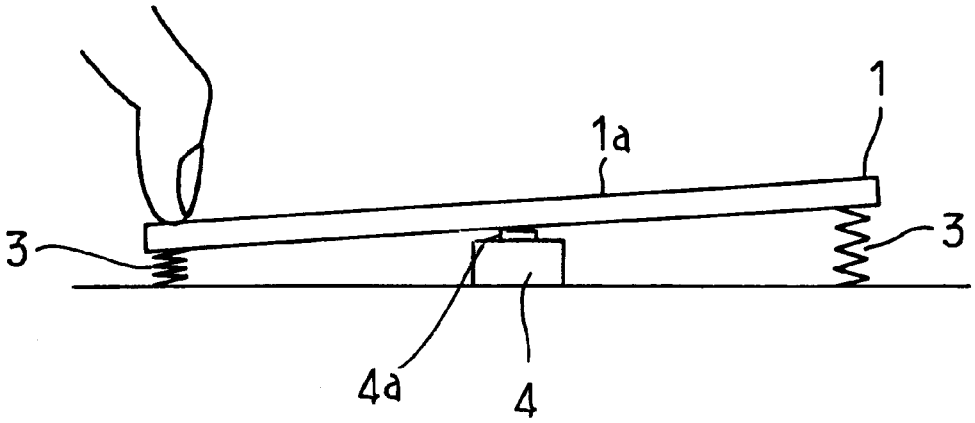
FIG. 11 PRIOR ART
FIG. 11 illustrates the state where the operating plate of the prior art switch device is depressed.

One embodiment of the present invention will be described with reference to FIGS. 1 to 9. In the embodiment, the switch device in accordance with the invention is mounted on a household refrigerator. Referring first to FIG. 9, the construction of the refrigerator is shown. The refrigerator comprises a body 12 in which an upper refrigerating compartment 13 serving as a storage compartment is defined. The refrigerating compartment 13 has a front opening closed and opened by a door 4 mounted on hinges further mounted on the body 12 so that the door is caused to pivot. A magnet gasket 16 is mounted on a peripheral edge of a backside of the door 4. When the door 4 is closed, the magnet gasket 16 sticks to the front of the refrigerating compartment 13 of the refrigerator body 12 so that the door 4 is held in the closed state.

For example, a solenoid-operated door opening unit 17 is mounted on a top of the refrigerator body 12 so as to be located at a front end of the top opposed to the upper hinge 15. The door opening unit 17 comprises an electromagnetic solenoid (not shown) and a push rod 18 caused to project forward when the solenoid is energized. The door 14 has a pushed portion 19 formed on the top thereof so as to correspond to a distal end of the push rod 18.

An operation unit 11 is provided on a front of the door 14 and comprises an operation panel 20 and a switch device 21. The switch device 21 serves both as a switch device for switching an operation state of the door opening unit 17 and as a handle for the door 14. The door 14 has a recessed mounting section 22 formed thereon as shown in FIG. 8. A unit base 23 constituting an operation unit 11 is mounted on the mounting section 22. The operation panel 20 and an operating plate 29 of the switch device 21 are further mounted on the mounting section 22 so as to cover the unit base 23. A printed circuit board 24 is fixed to the unit base 23. A pair of shaft guides 28 having peak-shaped limiting portions 28*a* are provided on right-hand and left-hand sides of the lower portion of the unit base 23, respectively. A plurality of switches and light-emitting diodes are mounted on a portion of the printed circuit board 24 corresponding to the operation panel 20 although none of them are shown. A push-button switch 27 serving as a switching element is mounted on a portion of the printed circuit board 24 corresponding to the switch device 21. The push-button switch 27 includes an operating element 27*a* urged forward. The push-button switch 27 is turned on when the operating element 27*a* projects, whereas it is turned off when the operating element 27*a* is withdrawn against the urging force.

Figure 1:
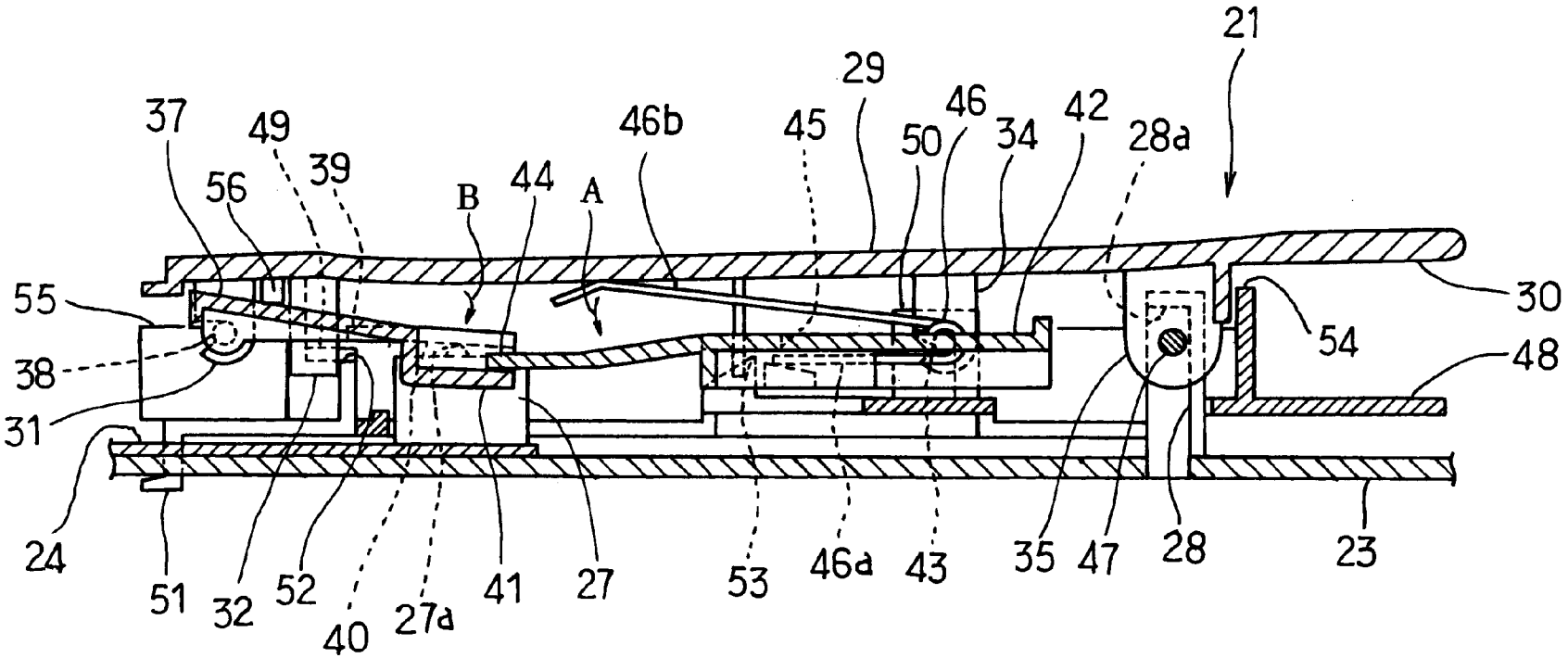
FIG. 1 is a longitudinally sectional side view of a switch device of a first embodiment in accordance with the present invention.
Figure 2:
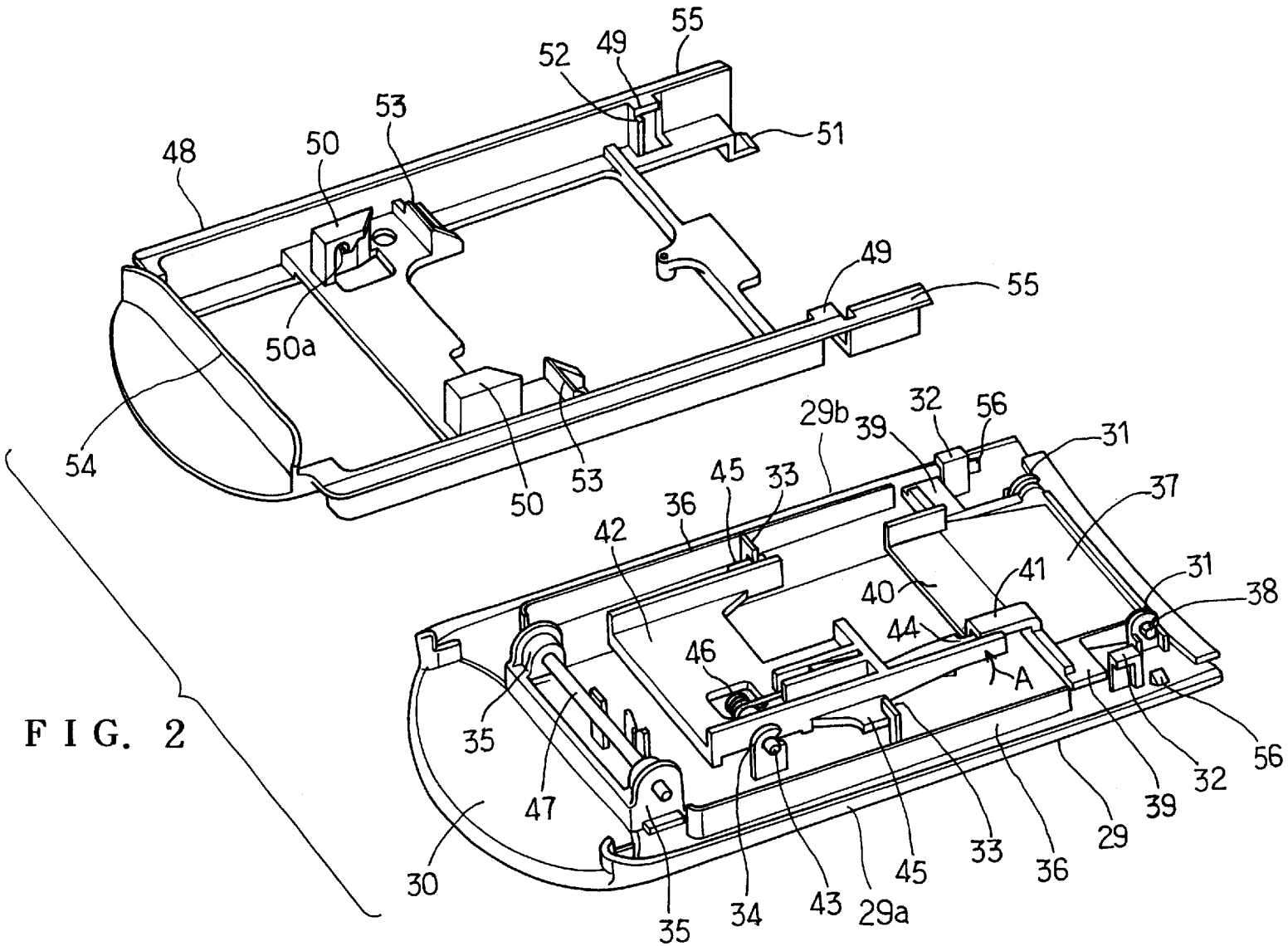
FIG. 2 is an exploded perspective view of an operating plate and an auxiliary base of the switch device.
Figure 3:
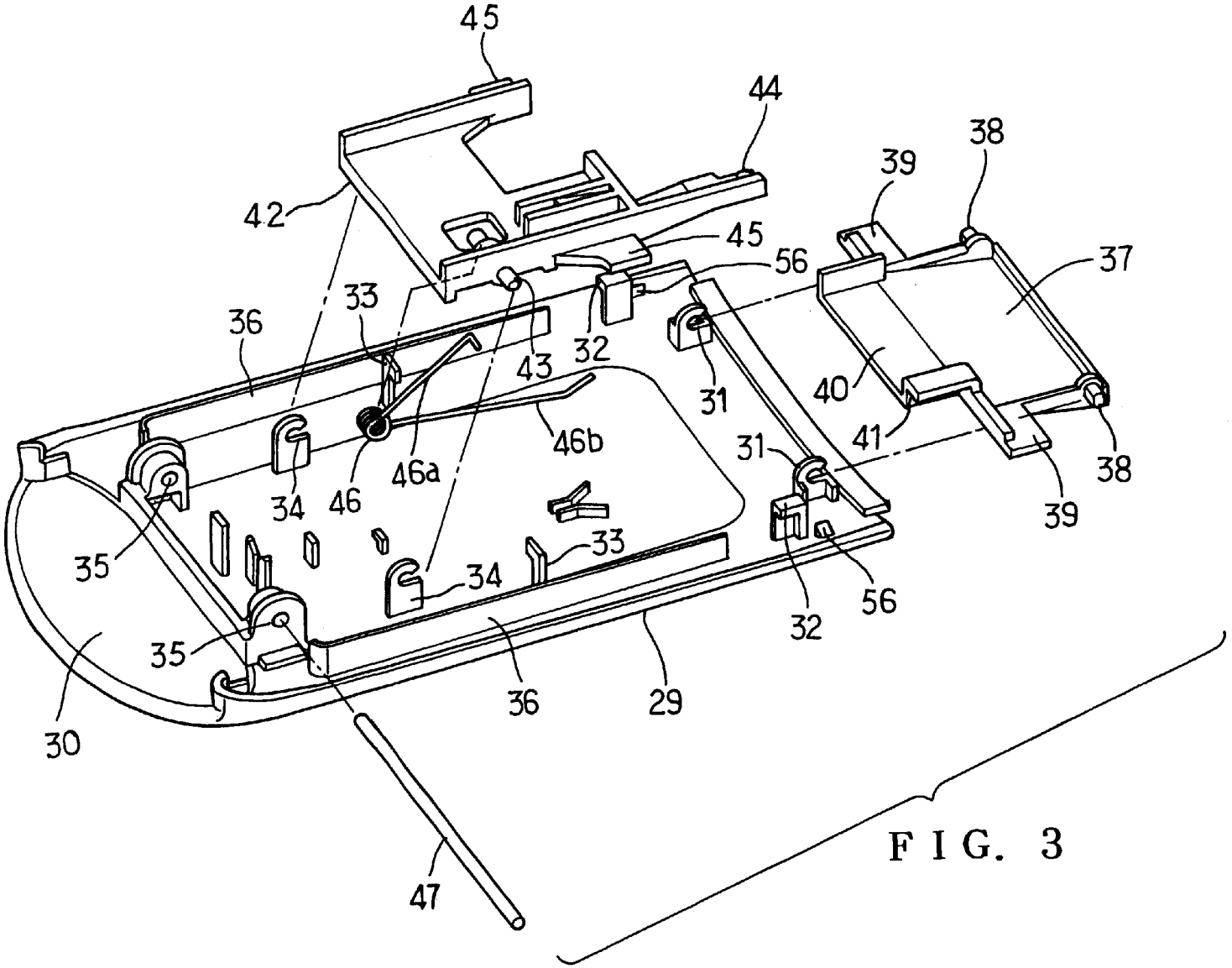
FIG. 3 is an exploded perspective view of the operating plate and first and second movable members of the switch device.

The construction of the switch device 21 will be described with reference to FIGS. 1 to 3. The switch device 21 comprises an operating plate 29 which is formed into a rectangular shape and is vertically long. The operating plate 29 has a hand hold 30 formed integrally at a lower end thereof. A pair of shaft supports 31, a pair of engaging portions 32 and a pair of convex portions 56 are formed on the right-hand and left-hand ends of an upper portion of the backside of the operating plate 29 respectively as shown in FIG. 2. A first movable member 37 has a pair of integrally formed shafts 38 supported on the shaft supports 31 respectively so that the first movable member 37 is pivotable. Each of the shafts 38 serves as a first pivot shaft. The first movable member 37 has a pair of projections 39 projecting outward from substantially middle portions of the right-hand and left-hand ends thereof respectively. The first movable member 37 further has a switch operating section 40 integrally formed at a lower end thereof. The switch operating section 40 has a generally L-shaped receiving portion 41 formed on one of the right-hand and left-hand ends thereof or on the right-hand end thereof in the embodiment as viewed in FIG. 2.

The operating plate 29 has a pair of generally L-shaped locking portions 33 formed on middle portions of the right-hand and left-hand ends of the backside thereof respectively. A pair of shaft supports 34 are formed on the backside of the operating plate 29 so as to be located lower than the corresponding shaft supports 34 respectively. A second movable member 42 has a pair of shafts 43 formed integrally on lower portions of right-hand and left-hand side walls thereof respectively. One of the shafts 43 is shown in FIGS. 1 to 3. The shafts 43 are inserted through the respective shaft supports 34 so that the operating plate 29 is pivotable about the shafts 43. Each of the shafts 43 serves as a second pivot shaft.

The second movable member 42 has an upwardly extending projection 44 formed integrally thereon so as to correspond to the receiving portion 41 of the switch operating section 40. The projection 44 engages the receiving portion 41. The second movable member 42 further has a pair of projections 45 projecting outward from upper portions of the right-hand and left-hand ends thereof respectively. The projections 45 engage the locking portions 33 respectively. The second movable member 42 is urged by a torsion coil spring 46 serving as an urging element in the direction of arrow A as shown in FIGS. 1 and 2. The torsion coil spring 46 has one end 46*a* caught by the second movable member 42 and the other end 46*b* abutting against the backside or inside of the operating plate 29 as shown in FIG. 1. The operating plate 29 has a pair of shaft supports 35 formed on the right-hand and left-hand ends of the backside thereof so as to be located over the hand hold 30, respectively. An operating plate shaft 47 extends through the shaft supports 35. The operating plate 29 further has a pair of ribs 36 formed on the right-hand and left-hand ends of the backside thereof respectively so as to extend vertically.

An auxiliary base 48 is disposed between the operating plate 29 and the unit base 23. The unit base 23 and the auxiliary base 48 serve as a base in the invention. The auxiliary base 48 has two engaging claws 51 formed on an upper end thereof. The auxiliary base 48 further has a pair of engaged portions 49 formed thereon so as to correspond to the engaging portions 32 of the operating plate 29 respectively. The auxiliary base 48 further has a pair of shaft guides 50 formed thereon so as to correspond to the shafts 43 of the second movable member 42 respectively. The shaft guides 50 have peak-shaped limiting portions 50a respectively. The engaging portions 32 engage the respective engaged portions 49, and the shafts 43 engage the respective shaft guides 50 so that the auxiliary base 48 is mounted on the backside of the operating plate 29.

The auxiliary base 48 has a pair of first operating portions 52 formed thereon so as to correspond to the projections 39 of the first movable member 37 respectively. The auxiliary base 48 further has a pair of second operating portions 53 formed thereon so as to correspond to the projections 45 of the second movable member 42 respectively. The auxiliary base 48 further has a stopper 54 formed on a lower portion thereof and two stoppers 55 formed on the right-hand and left-hand ends thereof respectively. The engaging claws 51 engage engaged portions (not shown) of the unit base 23 respectively so that the auxiliary base 48 is mounted on the unit base 23 so as to be prevented from falling off. The engaging portions 32 engage the respective engaged portions 49, and the shafts 43 engage the respective shaft guides 50 so that the auxiliary base 48 is mounted on the backside of the operating plate 29. Furthermore, in a state where the auxiliary base 48 and the operating plate 29 are mounted on the unit base 23, the shaft 47 is supported on the shaft guides 28 so as to be movable back and forth as viewed in FIG. 1.

The operation of the switch device will now be described with reference to FIGS. 1 and 4 to 7. First, when the door 14 of the refrigerating compartment 13 is closed, the operating plate 29 assumes the neutral position as shown in FIG. 1. At this time, the second movable member 42 is urged by the torsion coil spring 46 in the direction of arrow A and the receiving portion 41 of the first movable member 37 is pushed by the projection 44 rearward or downward as viewed in FIG. 1. As a result, the first movable member 37 is urged in the direction of arrow B in FIG. 1, whereupon the operating element 27*a* of the push-button switch 27 is depressed by the switch operating section 40. Accordingly, the operating element 27*a* is withdrawn such that the push-button switch 27 is in the OFF state.

The first and second operating portions 52 and 53 are spaced from the projections 39 and 45 respectively when the operating plate 29 assumes the neutral position. The reason for this is that even in a case where parts of the switch device 21 have respective dimensional errors, the first and second operating portions 52 and 53 are prevented from pushing the first and second movable members 37 and 42 respectively. Further, when assuming the neutral position, the operating plate 29 is spaced from the stoppers 54 and 55 of the auxiliary base 48 and both ends of the operating plate shaft 47 are spaced from the limiting portions 28*a* of the shaft guides 28 respectively. The shafts 43 of the second movable member 42 are in abutment with the limiting portions 50*a* of the shaft guides 50 from below.

Figure 4:
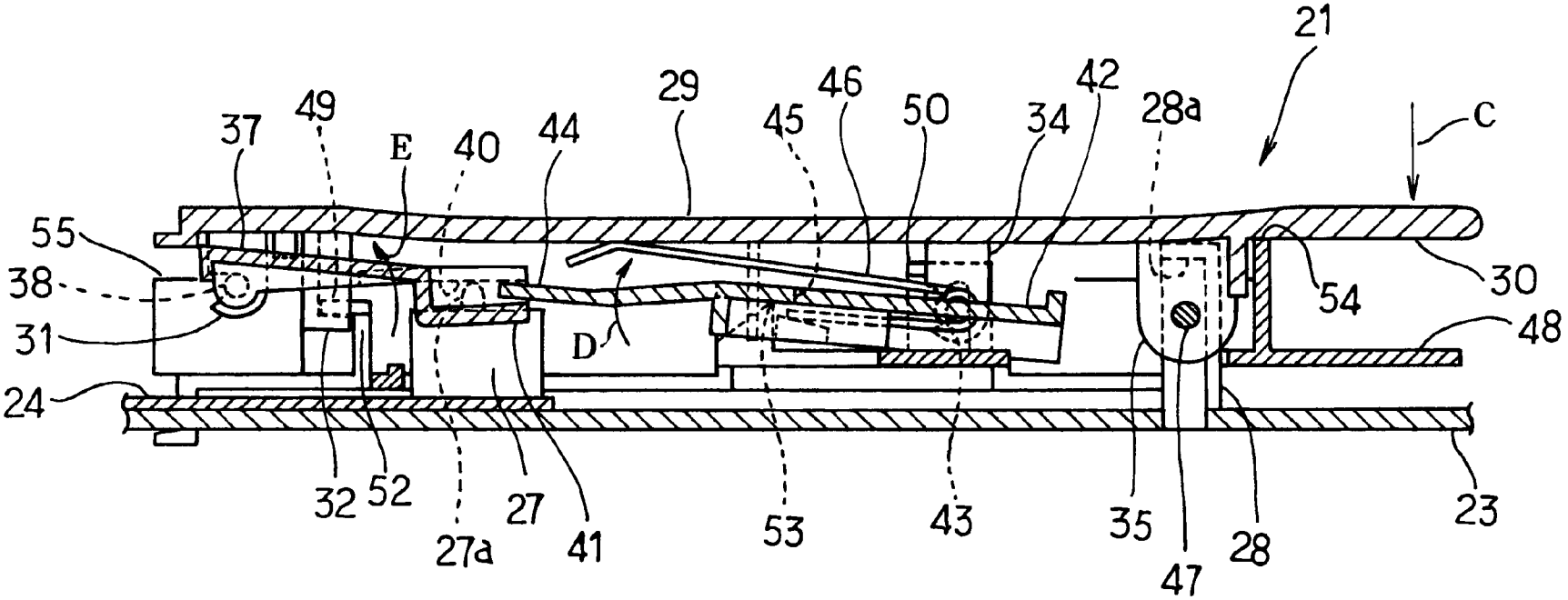
FIG. 4 is a longitudinally sectional side view of the switch device, showing the first and second movable members when a lower end portion of the operating plate is depressed.

On the other hand, FIG. 4 shows a case where a lower part of a front or outer surface of the operating plate 29 assuming the neutral position is depressed in the direction of arrow C. In this case, the operating plate 29 is caused to pivot about the engaged portions of the engaging and engaged members 32 and 49 in the direction of arrow C until the backside of the plate 29 abuts against the stopper 54, whereupon the operating plate is displaced to assume a proximity position where it is in proximity to the unit base 23 or the auxiliary base 48. As a result, the projections 45 abuts against the second operating portions 53 respectively such that the second movable member 42 is caused to pivot about the shafts 43 against the urging force of the torsion coil spring 46 in the direction of arrow D in FIG. 4 or opposite to arrow A. The projection 44 of the second movable member 42 is then spaced from the receiving portion 41 such that the first movable member 37 assumes a free state. As a result, the operating element 27*a* projects forward so that the push-button switch 27 is switched to the ON state. Further, the switch operating section 40 is pushed upward as the result of projection of the operating element 27*a*, whereupon the first movable member 37 is caused to pivot in the direction of arrow E or opposite arrow B.

Figure 5:
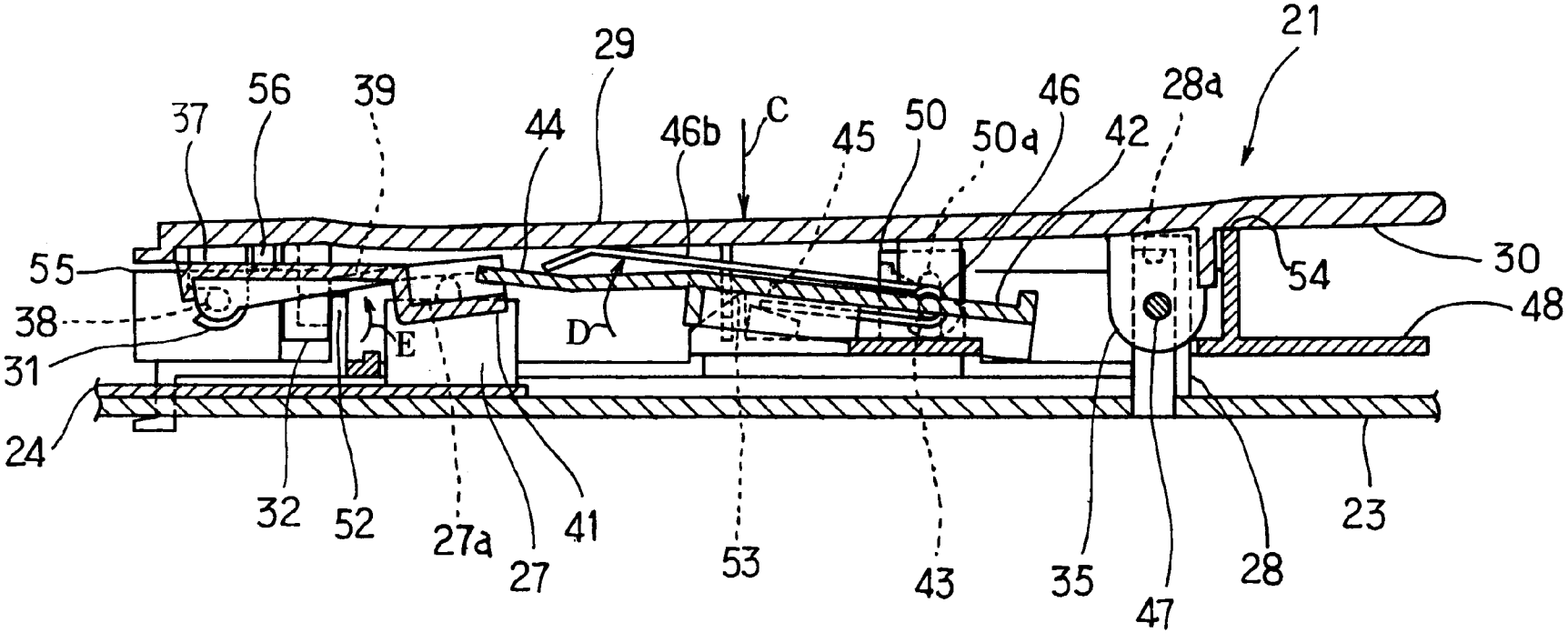
FIG. 5 is a longitudinally sectional side view of the switch device, showing the first and second movable members when a central portion of the operating plate is depressed.

FIG. 5 shows a case where a middle part of the front or outer surface of the operating plate 29 assuming the neutral position is depressed in the direction of arrow C. In this case, the overall operating plate 29 is moved toward the auxiliary base 48 until the backside thereof abuts against the stoppers 54 and 55. As a result, the operating plate 29 is displaced to assume another proximity position where it is in proximity to the auxiliary base 48 or the unit base 23. The projections 39 then abut against the first operating portions 52 respectively, whereupon the first movable member 37 is caused to pivot about the shafts 38 in the direction of arrow E. Further, the projections 45 abut against the second operating portions 53 respectively such that the second movable member 42 is caused to pivot about the shafts 43 in the direction of arrow D against the urging force of the torsion coil spring 46. The operating element 27*a* projects forward with the pivot of the first movable member 37 in the direction of arrow E. Consequently, the push-button switch 27 is switched to the ON state.

Figure 6:
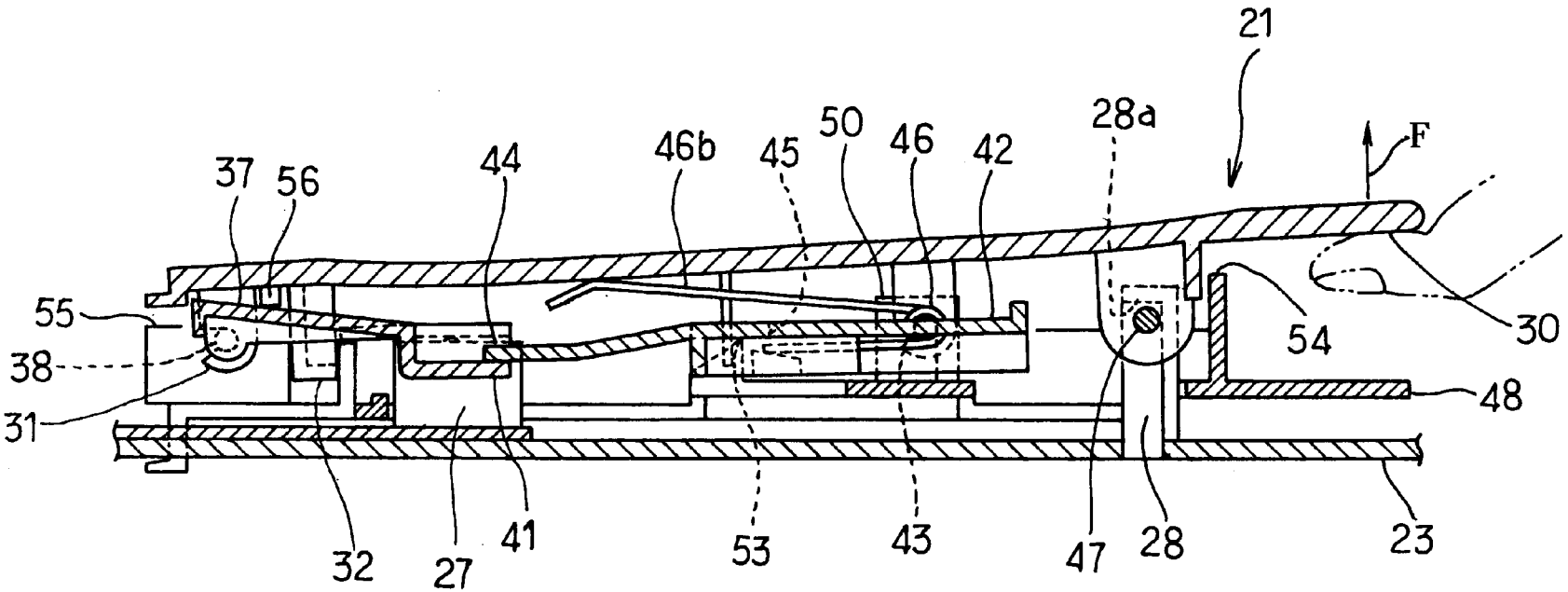
FIG. 6 is a longitudinally sectional side view of the switch device, showing the first and second movable members at an initial stage when a hand hold of the operating plate is drawn.

FIG. 6 shows a case where the hand hold 30 is caught by fingers so that the operating plate 29 assuming the neutral position is drawn in the direction of arrow F. In this case, first, the shafts 43 abut against the limiting portions 50*a* of the shaft guides 50 respectively, so that the operating plate 29 is caused to pivot about the shafts 43 in the direction of arrow F until the operating plate shaft 47 abuts against the limiting portions 28*a* of the shaft guides 28. Accordingly, each shaft 43 serves as an operating plate shaft. When the shaft 47 abuts against the limiting portions 28*a* of the shaft guides 28, the operating plate 29 is caused to pivot about the shaft 47 in the direction of arrow F as shown in FIG. 7. The operating plate 29 pivots until the convex portions 56 abut against the respective stoppers 54. Consequently, the operating plate 29 is displaced to assume a distant position where it is spaced away from the unit base 23 or the auxiliary base 48. At this time, the projections 39 abut against the first operating portions 52 respectively such that the first movable member 37 is caused to pivot in the direction of arrow E. With this, the operating element 27*a* projects forward so that the push-button switch 27 is switched into the ON state.

When any upper part of the front of the operating plate 29 assuming the neutral position is depressed in the direction of arrow C, the operating plate 29, the first movable member 37, etc. are operated substantially in the same manner as in the case where the operating plate 29 is drawn. In this case, the operating plate 29 is displaced to assume the proximity position where the upper portion thereof is in proximity to the unit base 23. However, the state of the operating plate 29 is substantially the same as that of the plate assuming the distant position as shown in FIG. 7. Accordingly, the distant position corresponds to one of the proximity positions of the operating plate 29. Furthermore, when any part other than the lower, middle and upper parts of the front of the operating plate 29 is depressed, the operating plate 29, the first and second movable members 37 and 42, etc. are operated in the same manners as shown in FIGS. 4 to 7, whereupon the push-button switch 27 is switched to the ON state.

When the push-button switch 27 is switched to the ON state, the electromagnetic solenoid of the door opening unit 17 is energized so that the push rod 18 projects forward. Consequently, the pushed portion 19 of the door 14 is depressed by the push rod 18 so that the door 14 is opened against a sticking force of the gasket 16.

According to the foregoing embodiment, the push-button switch 27 can be switched from the OFF state to the ON state when any part of the front of the operating plate 29 is depressed. Further, at least one of the first and second movable members 37 and 42 is caused to pivot against the urging force upon depression of the operating plate 29. The first movable member 37 is caused to pivot upon the pivoting of the second movable member 42. When the first movable member 37 pivots, the operating element 27*a* projects forward so that the push-button switch 27 is switched to the ON state. Accordingly, even when any part of the front of the operating plate 29 is depressed, the first movable member 37 is reliably caused to pivot so that the push-button switch 27 can reliably be switched to the ON state. Consequently, an operable range of the operating plate 29 can be broadened.

The auxiliary base 48 has the first and second operating portions 52 and 53 disposed to correspond to both lateral ends of the operating plate 29. Accordingly, even when any part of the lateral ends of the front of the operating plate 29 is depressed, the first and second movable members 37 and 42 are reliably caused to pivot such that the push-button switch 27 can reliably be switched to the ON state. Furthermore, the push-button switch 27 is also switched to the ON state when the operating plate 29 is drawn or pulled outward. As a result, the door opening unit 17 can be operated by the user substantially in the same manner as in the prior art in which a refrigerator door is manually opened, whereupon the convenience of the refrigerator can be improved.

The operating element 27*a* of the push-button switch 27 is depressed by the switch operating section 40 of the first movable member 37 before the operating plate 29 is operated. When the operating plate 29 is operated, the operating element 27*a* is released from the depression by the switch operating section 40. Accordingly, the operating element 27*a* can be prevented from being subjected to a strong shock when the operating plate 29 is operated. Consequently, breakage of the operating element 27*a* can be prevented. Additionally, when the operating plate 29 is released from depression, the torsion coil spring 46 exerts a spring force which causes the switch operating section 40 to depress the operating element 27*a*, whereupon a shock applied to the operating element 27*a* is small.

The center of rotative movement or a pivot about which the operating plate 29 pivots transfers from the shafts 43 to the operating plate shaft 47 in the middle of the displacement of the operating plate 29 from the neutral position to the distant position. Accordingly, a distance between the pivot of the operating plate 29 and the hand hold 30 is increased at an initial stage of the drawing of the operating plate. Consequently, the pivoting of the operating plate 29 can be initiated by application of a small force to the hand hold 30. Further, the distance between the pivot of the operating plate 29 and the hand hold 30 is reduced at a last stage of the drawing of the operating plate. Consequently, even if a large force is applied to the hand hold 30 at the last stage of the drawing of the operating plate 29, the moment acting on the pivot of the operating plate 29 or the operating plate shaft 47 and the limiting portions 50*a* receiving the shaft 47. As a result, breakage of the shaft 47 and the limiting portions 50*a* can be prevented.

Although the torsion coil spring 46 urges the second movable member 42 in the foregoing embodiment, a compression coil spring may be provided, instead. Further, the push-button switch 27 serves as the switching element in the foregoing embodiment. However, a photo-interrupter may be provided for the same purpose, instead. Although the auxiliary base 48 and the unit base 23 are discrete in the foregoing embodiment, they may be integral with each other. Additionally, the present invention is applied to the switch device provided on the door of the refrigerator to serve as a door switch, in the foregoing embodiment, it may be provided on other equipment for another purpose.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

I claim:

1. A switch device comprising:

a base;

an operating plate disposed opposite the base and including an outer face depressed at any part thereof so that the operating plate is displaced from a neutral position to a proximity position where the operating plate is in proximity to the base;

a first movable member provided between the base and the operating plate and having a first pivot shaft, wherein said pivot shaft is supported by shaft supports extending from said base, and extends along the operating plate and about which the first movable member is caused to pivot when the operating plate is depressed;

a second movable member provided between the base and the operating plate and having a second pivot shaft, spaced from and extending in parallel with the first pivot shaft, the first movable member pivoting about the first pivot shaft when a predetermined part of the outer face of the operating plate is depressed, the second movable member pivoting about the second pivot shaft when a part of the outer face of the operating plate other than the predetermined part is depressed, the first movable member pivoting upon pivot of the second movable member;

a switching element provided on the base; and a switch operating section provided on the first movable member for switching a state of the switching element when the first movable member pivots.

2. The switch device according to claim 1 ,wherein when drawn, the operating plate is displaced from the neutral position to a distant position spaced away from the base so that at least one of the first and second movable members is caused to pivot.

3. The switch device according to claim 2, further comprising a pair of first operating portions provided on portions of the base corresponding to both opposite ends of the operating plate, the first operating portions causing the first movable member to pivot when the operating plate is depressed or drawn, and a pair of second operating portions provided on portions of the base corresponding to said opposite ends of the operating plate, the second operating portions causing the second movable member to pivot when the operating plate is depressed or drawn.

4. The switch device according to claim 3, wherein while the operating plate is assuming the neutral position, the first movable member is spaced away from the first operating portion and the second movable member is spaced away from the second operating portion.

5. The switch device according to claim 2, wherein the switching element comprises a push-button switch having an operating element depressed by the switch operating section while the operating plate is assuming the neutral position.

6. The switch device according to claim 2, wherein the operating plate includes at least one operating plate shaft parallel with each of the first and second pivot shafts, the operating plate pivoting about at least one operating plate shaft.

7. The switch device according to claim 2, wherein the operating plate includes a plurality of operating plate shafts parallel with each of the first and second pivot shafts and a hand hold formed on one end of the operating plate, the hand hold being drawn so that the operating plate is caused to pivot about one of the operating plate shafts to be displaced from the neutral position to the distant position, and the operating plate has a pivot thereof transferred sequentially from the operating plate shaft locate away from the hand hold to the operating plate shaft located near the hand hold as operating plate is displaced from the neutral position to the distant position.

8. The switch device according to claim 1, further comprising a pair of first operating portions provided on portions of the base corresponding to both opposite ends of the operating plate, the first operating portions causing the first movable member to pivot when the operating plate is depressed, and a pair of second operating portions provided on portions of the base corresponding to said opposite ends of the operating plate, the second operating portions causing the second movable member to pivot when the operating plate is depressed.

9. The switch device according to claim 8, wherein while the operating plate is assuming the neutral position, the first movable member is spaced away from the first operating portion and the second movable member is spaced away from the second operating portion.

10. The switch device according to claim 1, further comprising a pair of first operating portions provided on portions of the base corresponding to both opposite ends of the operating plate, the first operating portions causing the first movable member to pivot when the operating plate is depressed, and a pair of second operating portions provided on portions of the base corresponding to said opposite ends of the operating plate, the second operating portions causing the second movable member to pivot when the operating plate is depressed.

11. The switch device according to claim 10, wherein while the operating plate is assuming the neutral position, the first movable member is spaced away from the first operating portion and the second movable member is spaced away from the second operating portion.

12. The switch device according to claim 1, wherein the switching element comprises a push-button switch having an operating element depressed by the switch operating section while the operating plate is assuming the neutral position.

13. The switch device according to claim 1, wherein the switching element comprises a push-button switch having an operating element depressed by the switch operating section while the operating plate is assuming the neutral position.

* * * * *